US006412619B1

(12) United States Patent
Ito et al.

(10) Patent No.: US 6,412,619 B1
(45) Date of Patent: Jul. 2, 2002

(54) APPARATUS FOR PROCESSING PAPER MONEY

(75) Inventors: Yukio Ito, Saitama; Yasuyuki Kodama, Sakado; Mitsugu Mikami, Kawagoe; Yoshikazu Mori, Saitama, all of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/463,335

(22) PCT Filed: May 20, 1999

(86) PCT No.: PCT/JP99/02626

§ 371 (c)(1),
(2), (4) Date: Jan. 21, 2000

(87) PCT Pub. No.: WO99/62034

PCT Pub. Date: Dec. 2, 1999

(30) Foreign Application Priority Data

May 22, 1998 (JP) ..... 10-141350

(51) Int. Cl.[7] ..... G07F 7/04
(52) U.S. Cl. ..... 194/206; 194/348
(58) Field of Search ..... 194/206, 207, 194/200, 348

(56) References Cited

U.S. PATENT DOCUMENTS 4,784,274 A * 11/1988 Mori et al. ..... 194/206 X
4,858,744 A * 8/1989 Dolejs et al. ..... 194/206
5,505,289 A * 4/1996 Watabe et al. ..... 194/348 X
5,605,214 A * 2/1997 Yukimoto et al. ..... 194/348
6,076,648 A * 6/2000 Hatamachi et al. ..... 194/206
6,105,747 A * 8/2000 Uemizo et al. ..... 194/206 X

FOREIGN PATENT DOCUMENTS

| | | |
|---|---|---|
| JP | 62-31382 | 2/1987 |
| JP | 2-038662 | 3/1990 |
| JP | 06052396 | 2/1994 |
| JP | 06131531 | 5/1994 |
| JP | 06176242 | 6/1994 |
| JP | 6-290329 | 10/1994 |
| JP | 7-272062 | 10/1995 |
| JP | 09319917 | 12/1997 |
| KR | 01-32630 | 12/1997 |

* cited by examiner

*Primary Examiner*—James R. Bidwell
(74) *Attorney, Agent, or Firm*—Hogan & Hartson, L.L.P.

(57) ABSTRACT

A bill identification device (20) is disposed in the vertical portion (6*b*) of a bill transporting route (6) that comprises a horizontal portion (6*a*) connected to a bill slot (3) and a vertical portion (6*b*) rising up substantially in a vertical direction from the downstream end of the horizontal portion (6*a*) whereby the drop in genuineness identification capability for an inserted bill can be prevented as much as possible even if a liquid such as salt water is poured into the bill slot (3).

5 Claims, 4 Drawing Sheets

APPARATUS FOR PROCESSING PAPER MONEY

TECHNICAL FIELD

The present invention relates to a bill processing unit used for e.g. a ending machine, a money-changing machine, a pachinko ball dispenser and a metal token dispenser.

BACKGROUND ART

In a main unit of dispensers handling bills (including coupons), a bill processing unit for judging the genuineness of an inserted bill and for storing only bills regarded as genuine is normally equipped.

The bill processing unit generally comprises bill transporting means which guides a bill inserted from a bill slot to the main body of the unit, bill identification means which judges the genuineness of the transported bill, and a stacker which sequentially stacks and contains the bills regarded as genuine.

FIG. 6 is a partially-cutaway schematic cross-sectional side view of a major portion of a conventional bill-processing unit 1.

This bill processing unit 1 comprises a rectangular main body 2, where a front mask 4 where a bill slot 3 is formed is removably attached at the lower part of the front face 2*a* of the main body 2.

The front mask 4 where a bill slot 3 is formed is attached such that the tip, that is, the bill slot 3, is exposed to the outside from a front mask attachment hole formed on a door at the front face of such equipment as a dispenser, which is not illustrated.

A bill detection sensor 5 for judging whether a bill is inserted from the bill slot 3 is disposed directly behind the bill slot 3 that is formed in the front mask 4. Shutter means 7 for opening/closing a bill transporting route 6 connected to the bill slot 3 is disposed in the front mask 4 directly behind the bill detection sensor 5.

The shutter means 7 comprises a shutter 7*a* that moves vertically in the arrow A direction, by elevation means, which is not illustrated. Since the shutter 7*a* is disposed at a location very close to the bill slot 3, the shutter 7*a* is normally positioned at a position indicated by the solid line as an initial position, so as to open the bill transport route 6, because if the shutter 7*a* closes the bill transport route 6 at the initial position, then a bill inserted from the bill slot 3 may directly contact the shutter 7*a* causing jamming.

The bill transporting route 6 connected to the bill slot 3 is L shaped, and comprises a horizontal portion 6*a*, which is substantially parallel to the bill insertion direction, and a vertical portion 6*b*, which rises up substantially in a vertical direction from the end of the horizontal portion 6*a*.

The bill transporting means 8 for transporting the inserted bill along this L shaped bill transporting route 6 comprises a looped bill transporting belt 9, which is extended along the horizontal portion 6*a* and the vertical portion 6*b* of the bill transporting route 6, and belt driving means 10 which drives the rotation of the bill transporting belt 9.

The belt driving means 10 comprises driving pulleys 11, 12 and 13 for looping and stretching the bill transporting belt 9, slave pulleys 14 and 15, which are pressed against the cylindrical surface of the driving pulleys 11 and 12 disposed in the horizontal portion 6*a* of the bill transporting route 6, and pulley driving means 16, which drives the rotation of the above driving pulleys 11, 12 and 13. The pulley driving means 16 comprises a driving motor 17 and a power transmission device 18 for transferring the driving force of the driving motor 17 to the driving pulley 13. An idle pulley 19 for adjusting the tension of the belt is pressed against the bill transporting belt 9.

In the horizontal portion 6*a* of the bill transporting route 6, which is located directly behind the bill slot 3, the bill identification means 20 for judging the genuineness of an inserted bill is disposed.

This bill identification means 20 comprises various sensors including magnetic sensors, such as magnetic heads, for judging the genuineness of a bill, and photo sensors disposed facing each other. Elements 20*a* and 20*b* of the bill identification means 20 are disposed facing each other at a top chute 21 and a bottom chute 22 of the horizontal portion 6*a* of the bill transporting route 6.

In accordance with this bill processing unit 1, when a bill is inserted into the bill slot 3, the bill detection sensor 5, which is disposed in the front mask 4, detects the existence of the inserted bill, the inserted bill is transported horizontally in the right direction shown in the drawing along the horizontal portion 6*a* of the bill transporting route 6 by the transporting force of the bill transporting belt 9, which rotates counterclockwise, which is the normal rotation, based on the detection signal.

When the inserted bill is horizontally transported in the right direction shown in the drawing along the horizontal portion 6*a* of the bill transporting route 6 by normal rotation (counterclockwise rotation) of the bill transporting belt 9, and passes the bill identification means 20, the bill identification means 20 judges the genuineness of the inserted bill.

If the bill identification means 20 judges the inserted bill as counterfeit, the bill transporting belt 9 rotates in reverse (clockwise rotation), so as to return the inserted bill back through the bill slot 3.

If the bill identification means 20 judges the inserted bill as genuine, the bill transporting belt 9 continues normal rotation based on the detection signal, the inserted bill is transported changing direction to substantially 90° up along the vertical portion 6*b* of the bill transporting route 6, and is transported to the stacker 21 which is removably disposed on the rear face 2*b* of the main body 2, where the inserted bill, regarded as genuine, is stacked in the stacker 21 one by one via a known bill storing means.

As the known bill storing means, which is not illustrated here, disposed in the main body 2, various types are available, for example, the type that contains bills in the stacker 21 using a pantograph type linking mechanism, or the type that contains bills in the stacker 21 by rotating a drum which has bill insertion slots on its surface.

In the conventional bill processing unit 1, a part of the L shaped bottom chute 22 of the bill transporting route 6 is structured to be rotatable on an axis, not illustrated here, as shown by arrow B, so as to make easier the maintenance and inspection operations of the bill identification means 20, such as cleaning, easier. Further, at the maintenance and inspection operations, the L shaped bottom chute 22 is rotated clockwise to expand the space between the top chute 21 and the bottom chute 21, which makes it easier to clean each element 20*a* and 20*b* of the bill identification means 20.

Since the L shaped bottom chute 22 is supported to be rotatable as shown by the arrow B, the element 20*b* of the bill identification means 20, disposed at the bottom chute 21, and a control unit, not illustrated here, disposed in the main body 2, are electrically connected by one cable 23 which is connected to the control unit, the other cable 24 which is connected to the element 20*b* of the bill identification means 20, and a connector 25 which connects these cables 23 and 24.

In FIG. 6, the numeral 26 indicates a stacker motor, which is disposed in the main body 2, and drives the bill storing means.

In accordance with the above mentioned conventional bill processing unit 1, each element 20*a* and 20*b* of the bill identification means 20 is disposed in the horizontal portion 6*a* of the bill transporting route 6 located directly behind the bill slot 3. Therefore, if liquid, such as salt water, enters from the bill slot 3, for example, the liquid would easily reach the elements 20*a* and 20*b* of the bill identification means 20, and when the liquid attaches and dries on the elements 20*a* and 20*b* of the bill identification means 20, the bill identification function of the bill identification means 20 would become inoperable.

Also in accordance with the above mentioned conventional bill processing unit 1, the shutter 7*a* of the shutter means 7 is set such that the bill transporting route 6 is constantly open when the shutter 7*a* is at the initial position. Therefore, if a foreign object is inserted into the bill transporting route 6, the foreign object would easily reach the elements 20*a* and 20*b* of the bill identification means 20, and the bill identification means 20 would be subject to damage.

With the foregoing in view, it is an object of the present invention to provide a bill processing unit which can prevent a drop in genuineness identification capability for an inserted bill as much as possible, even if the bill slot is subject to a mischievous act.

DISCLOSURE OF THE INVENTION

To solve the above problems, a first bill processing unit in accordance with the present invention comprises a bill transporting route having a horizontal portion disposed substantially in a horizontal direction from a bill slot and a vertical portion disposed rising up substantially in a vertical direction from a downstream end of the horizontal portion; bill transporting means for transporting a bill inserted from the bill slot along the bill transporting route; and bill identification means disposed in the middle of the bill transporting route for identifying the genuineness of the bill being transported, the bill transporting route, the bill transporting means and the bill identification means being provided in a main body of the unit, wherein the bill identification means is disposed in the vertical portion of the bill transporting route.

A second bill processing unit in accordance with the present invention comprises a bill transporting route having a horizontal portion disposed substantially in a horizontal direction from a bill slot and a vertical portion disposed rising up substantially in a vertical direction from a downstream end of the horizontal portion; bill transporting means for transporting a bill inserted from the bill slot along the bill transporting route; bill identification means disposed in the middle of the bill transporting route for identifying the genuineness of the bill being transported; and shutter means disposed in the middle of the bill transporting route for opening or closing the bill transporting route at predetermined timing, the bill transporting route, the bill transporting means, the bill identification means and shutter means being provided in a main body of the unit, wherein the bill identification means is disposed in the vertical portion of the bill transporting route, and the shutter means is disposed in the vertical portion of the bill transporting route which is located downstream of the bill identification means, so that the shutter means normally closes the bill transporting route.

BEST MODE FOR CARRYING OUT THE INVENTIONS

An embodiment of a bill processing unit in accordance with the present invention will now be described in detail.

Figure 1:
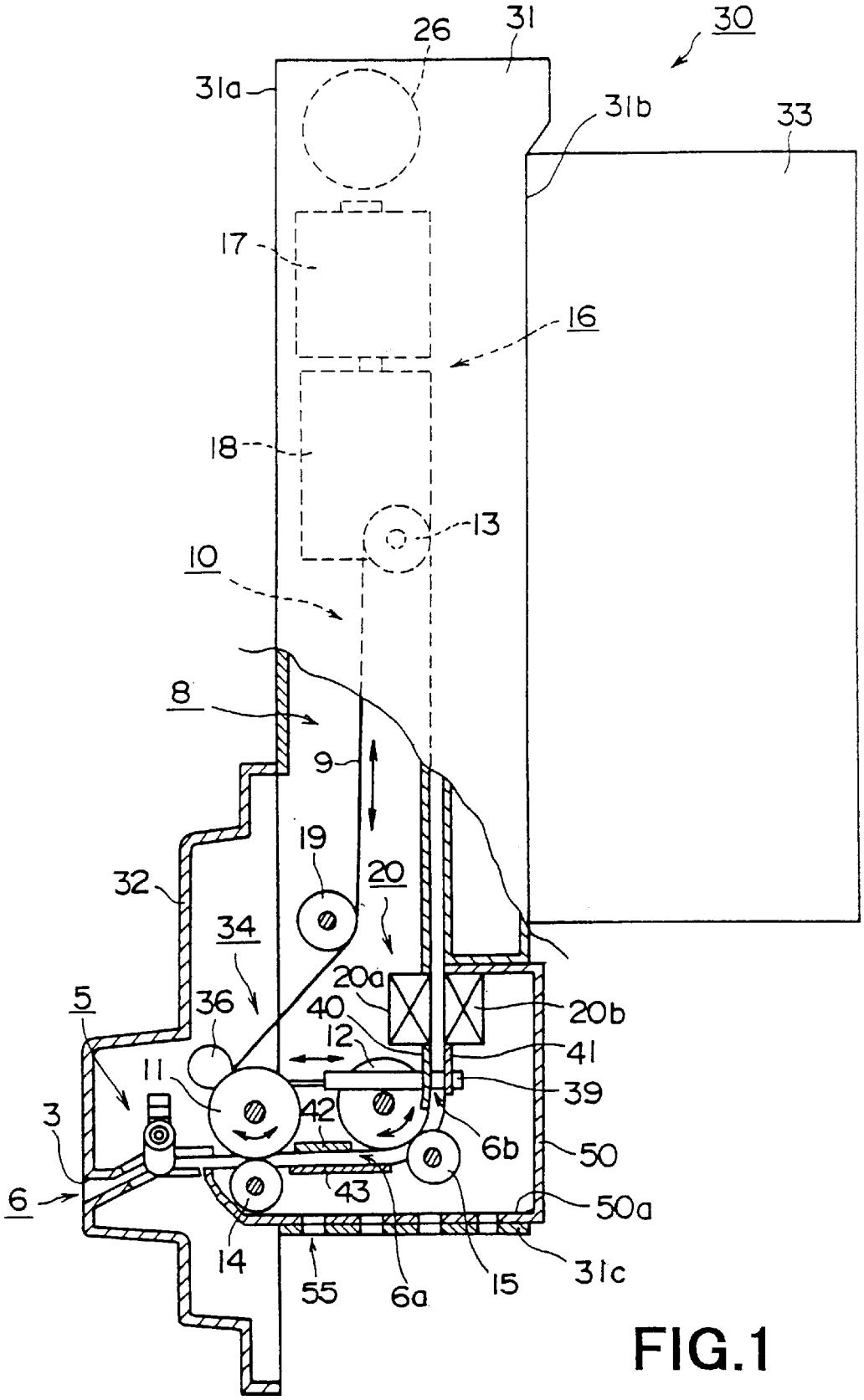
FIG. 1 is a partially-cutaway schematic cross-sectional side view of the major portion of a bill processing unit in accordance with the present invention.
Figure 6:
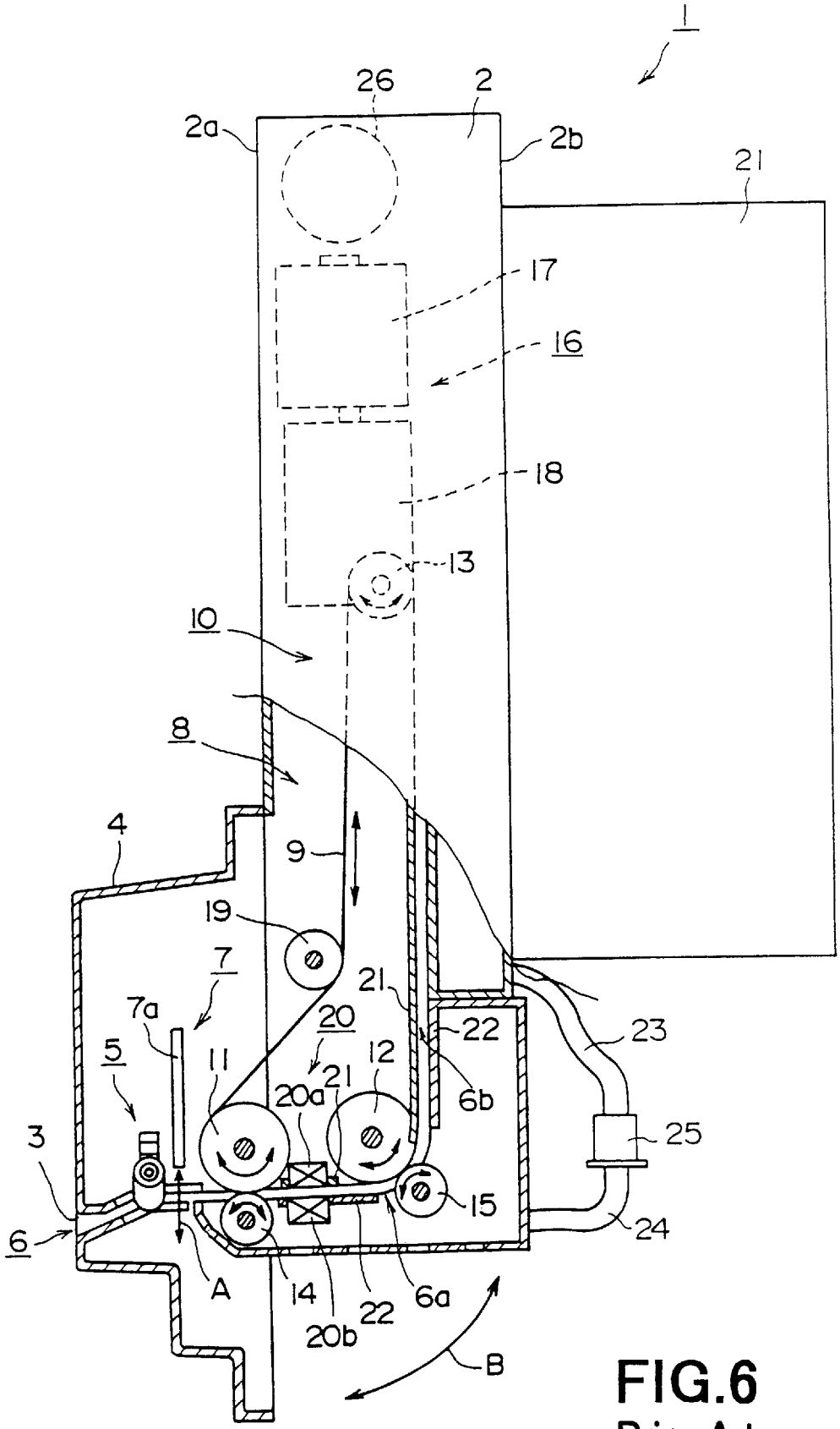
FIG.6 Prior Art
FIG. 6 is a partially cutaway schematic side view of a major portion of a conventional bill processing unit.

FIG. 1 is a partially cutaway schematic cross-sectional side view of a major portion of a bill processing unit 30 in accordance with the present invention, where identical parts as FIG. 6 are denoted by the same reference characters.

Just like the conventional type, this bill processing unit 30 also comprises a rectangular main body 31, where a front mask 32 in which a bill slot 3 is formed is removably attached at the lower part of the front face 31 a of the main body 31. The front mask 32 is attached in such a manner, just like the conventional type, that the tip, that is, the bill slot 3, is exposed to the outside from a front mask attachment hole formed on a door at the front face of such an equipment as a dispenser, which is not illustrated.

In the front mask 32 and the main body 31, there is formed an L shaped bill transporting route 6 which extends from directly behind the bill slot 3 to a stacker 33 removably disposed on the rear face 31*b* of the main body 31. The L shaped bill transporting route 6 is connected to the bill slot 3 and comprises a horizontal portion 6*a* which is substantially parallel to the bill insertion direction and a vertical portion 6*b* which raises up substantially in a vertical direction from the end of the horizontal portion. A transporting means 8 for transporting an inserted bill is disposed along the L shaped bill transporting route 6, just like the conventional type.

In this bill processing unit 30,: each element 20*a* and 20*b* of bill identification means 20 for judging the genuineness of a bill to be transported along the bill transporting route 6 is disposed in the vertical portion 6*b* of the bill transporting route 6. Just like the conventional, this bill identification means 20 comprises various sensors, including magnetic sensors, such as a magnetic heads, for judging the genuineness of a bill and photo sensors disposed facing each other.

Shutter means 34 for opening/closing the bill transporting route 6 at predetermined timing is also disposed in the vertical portion 6*b* of the bill transporting route 6 so as to be positioned downstream of the above mentioned bill identification means 20.

Figure 2:
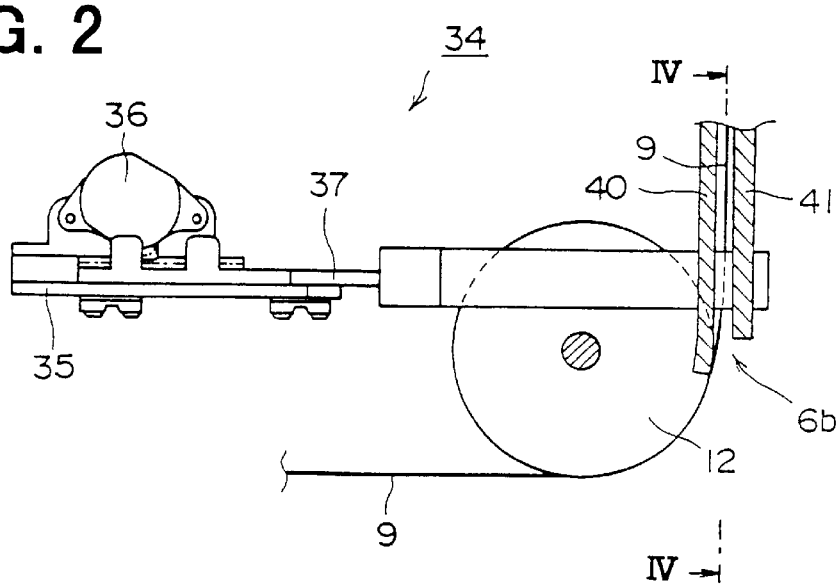
FIG. 2 is an enlarged view of the major portion in FIG. 1.

As FIG. 2, which is an enlarged view of the major portion in FIG. 1, shows, the shutter means 34 comprises a first plate 35 secured to the main body 31 (FIG. 1), and a second plate 37, which is supported such that the drive force of a driving motor 36 mounted on the first plate 35 can be slid in the left and right directions via a reduction mechanism having a large speed reduction ratio, such as a worm gear. At the right end of this second plate 37, a shutter 39 comprising a plurality of plates 38, which are assembled in an alternate orientation (staggered), is disposed as FIG. 3, which is a top view of FIG. 2, shows.

Of the plurality of plates 38, a plate 38*a* disposed at the center is formed such that the cross-section substantially has a "<" shape, and others are formed such that the cross-section is substantially rectangular.

Figure 3:
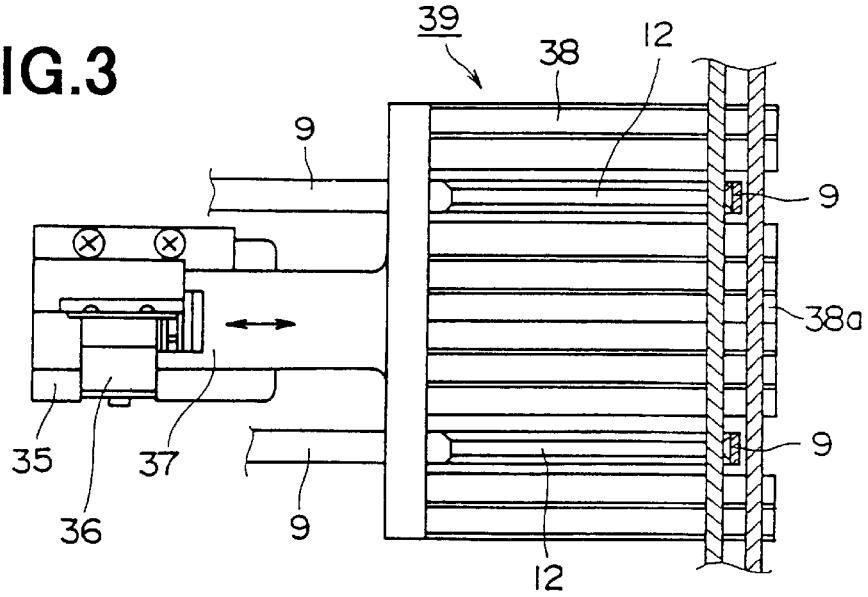
FIG. 3 is a top view of FIG. 2.

Since the plurality of plates 38 of the shutter 39 are assembled in an alternate orientation, the entire area of the shutter 39 in the width direction is covered by each of the plates 38 with almost no opening, except for the portion where a pair of transporting belts 9, which are looped around a pair of driving pulleys 12, are exposed, as the top view in FIG. 3 (same as the bottom view) shows.

Figure 4:
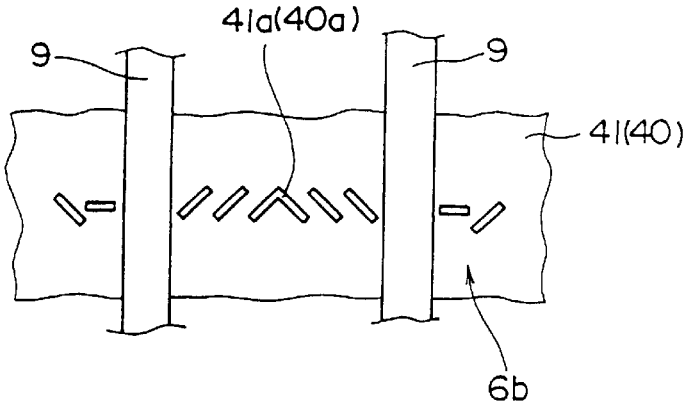
FIG. 4 is a schematic cross-sectional view taken along line IV—IV of FIG. 2.

As shown in FIG. 4, which is a cross-sectional view taken along line IV—IV of FIG. 2 excluding the above mentioned plates 38, a plurality of holes 40*a* and 41*a*, having a shape corresponding to the cross-sectional shape of each one of the plurality of plates 38, are formed in the top and bottom chutes 40 and 41 constituting the vertical portion 6*b* at the position where the shutter 39 is disposed, so that the plurality of plates 38 (FIG. 3) constituting the shutter 39 can move in and out respectively.

When a bill is inserted, the shutter 39 of the shutter means 34 opens/closes the bill transporting route 6, that is, the part between the top and bottom chutes 40 and 41 in the vertical portion 6*b*, at predetermined timing. However, during standby time when a bill is not inserted, the shutter 39 is set at an initial position which keeps the bill transporting route 6 constantly closed.

In this bill processing unit 30, as FIG. 1 shows, among the top and bottom chutes 42 and 43 constituting the horizontal portion 6*a* of the bill transporting route 6 and the top and bottom chutes 40 and 41 constituting the vertical portion 6*b* of the bill transporting route 6, the entire area of the bottom chute 43 of the horizontal portion 6*a* and the upstream bottom chute 41 of the vertical portion 6*b* are integratedly formed by a substantially L shaped box 50. The box 50 has a slide support means, which is not illustrated, comprising a guide groove and a guide protrusion to be guided along the guide groove, for example, formed on both sides of the box 50 and on both sides of the inner surface of the main body 31, as shown by the dash and dotted line in FIG. 5, and is removably attached in the arrow D direction.

On the side of this box 50 and on the side of the main body 31 facing the box 50, a plug 52 constituting a connector 51 and a receptacle 53 which the plug 52 is plugged into are disposed respectively, and the plug 52 is electrically connected to one of the elements 20*b* of the bill identification means 20 disposed in the bottom chute 41 of the vertical portion 6*b* shown in FIG. 1, and the receptacle 53 is connected to a control unit, which is not illustrated, disposed in the main body 31.

Figure 5:
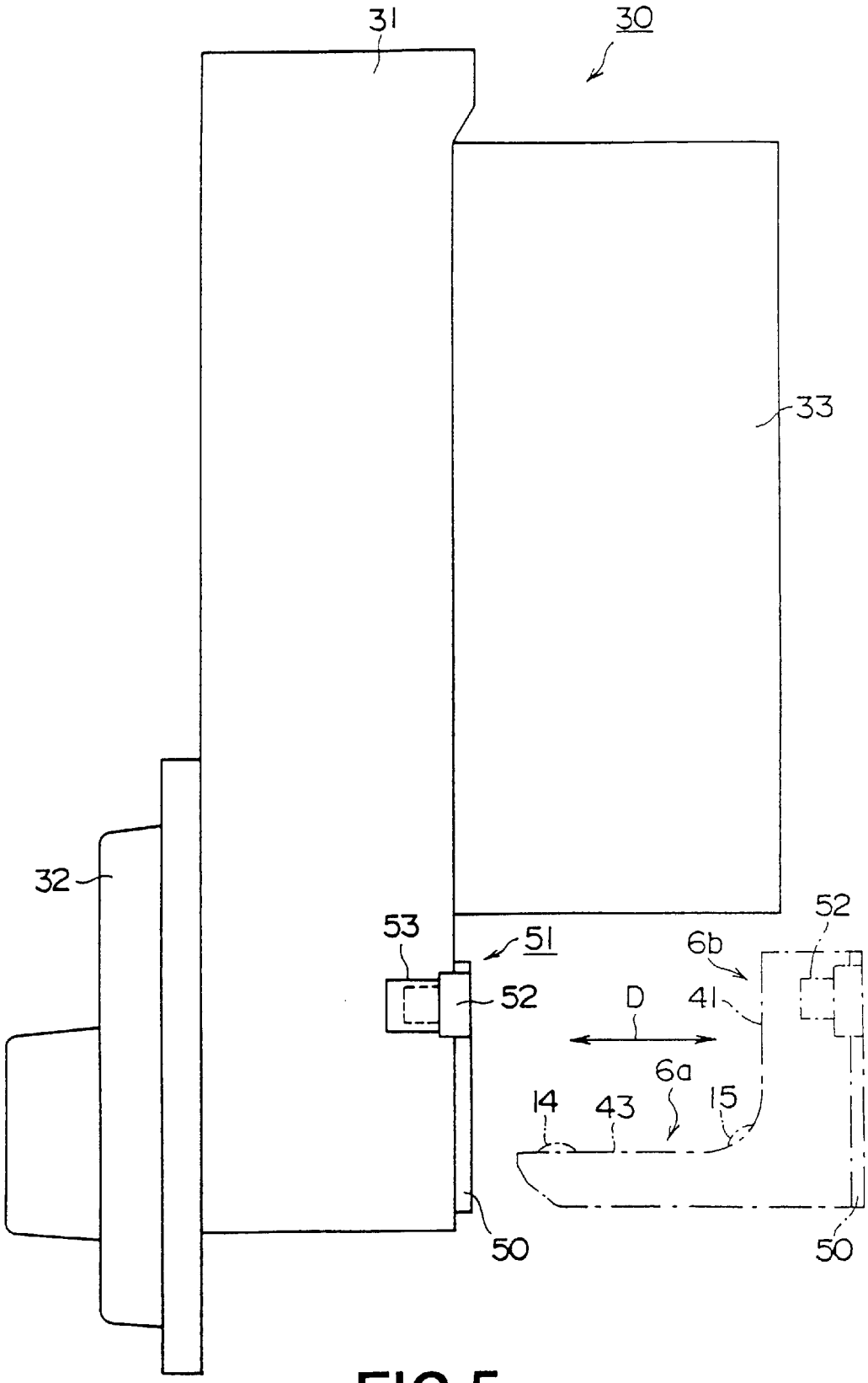
FIG. 5 is a side view of a bill processing unit in accordance with the present invention.

When the box 50 is attached to the main body 31, as the solid line in FIG. 5 shows, the plug 52 is plugged into the receptacle 53 at the same time, and one of the elements 20*b* of the bill identification means 20 disposed in the box 50 and the control unit, which is not illustrated, disposed in the main body 31, is electrically connected so as to activate the bill identification means 20.

Now the operation of the above mentioned bill processing unit 30 will be described.

When a bill is inserted into the bill slot 3 shown in FIG. 1, the bill detection sensor 5 disposed at the bill slot 3 detects the existence of the inserted bill, and the inserted bill is transported horizontally to the right direction shown in the drawing along the horizontal portion 6*a* of the bill transporting route 6 by the transporting force of the bill transporting belt 9 which rotates based on the detection signal. At the same time, the driving motor 36 of the shutter means 34 (FIG. 2) is driven, by which the shutter 39 is moved to the left direction shown in the drawing so as to open the vertical portion 6*b* of the bill transporting route 6.

When the inserted bill is horizontally transported to the right direction shown in the drawing along the horizontal portion 6*a* of the bill transporting route 6 by the rotation of the bill transporting belt 9, and is then transported turning substantially 90° up along the vertical portion 6*b* of the bill transporting route 6, the bill identification means 20 disposed in the vertical portion 6*b* judges the genuineness of the inserted bill.

If the bill identification means 20 judges the inserted bill as counterfeit, the bill transporting belt 9 rotates in reverse so as to return the inserted bill back through the bill slot 3.

If the bill identification means 20 judges the inserted bill as genuine, the bill transporting belt 9 continues normal rotation based on the detection signal, and the inserted bill is transported to the stacker 33 side, which is removably disposed on the rear face 31*b* of the main body 31. In the stacker 33, the inserted bill regarded as genuine is stacked one by one via a known bill storing means, and thus a series of bill identification and storing processes ends.

In accordance with the above mentioned bill processing unit 30, the bill identification means 20 is disposed in the vertical portion 6*b* of the bill transporting route 6, as shown in FIG. 1. Therefore, even if such a liquid as salt water is poured into the bill slot 3, for example, the liquid does not easily reach each element 20*a* and 20*b* of the bill identification means 20, and as a consequence a mischievous act which drops the bill identification function of the bill identification means 20 can be prevented as much as possible. In this embodiment, such a liquid as salt water poured into the slot 3 drops to the bottom of the bill processing unit 30 and is removed through a plurality of drain holes 55 formed on the bottom face 50*a* of the L shaped box 50 and the bottom face 31*c* of the main body 31 respectively.

Also in accordance with the bill processing unit 30 of the present invention, the bill identification means 20 is disposed in the vertical portion 6*b* of the bill transporting route 6, the shutter means 34 is disposed in the vertical portion 6*b* of the bill transporting route 6 at the downstream bill identification means, and the shutter means 34 normally closes the bill transporting route 6. Therefore, even if a foreign object is inserted into the bill transporting route 6 through the bill slot 3, the foreign object does not reach each element 20*a* and 20*b* of the bill identification means 20 because of the shutter 39, and as a consequence the foreign object cannot damage the bill identification means 20.

As described above, in accordance with the first bill processing unit of the present invention, the bill identification means is disposed in the vertical portion of the bill transporting route having the horizontal portion connected to the bill slot and the vertical portion rising up substantially in a vertical direction from the end of the horizontal portion. Therefore, even if such a liquid as salt water is poured into the bill slot, the liquid does not easily reach each element of the bill identification means and adhere thereto. As a consequence, a bill processing unit which can maintain stable genuine bill identification capability, even if the bill slot is subject to a mischievous act, can be provided.

In accordance with the second bill processing unit of the present invention, the bill identification means is disposed in the vertical portion of the bill transporting route having the horizontal portion connected to the bill slot and the vertical portion rising up substantially in a vertical direction from the end of the horizontal portion, the shutter means is also disposed in the vertical portion, and the shutter means normally closes the bill transporting route. Therefore, even if a foreign object is inserted into the bill transporting route through the bill slot, the foreign object does not reach each element of the bill identification means because of the shutter of the shutter means. As a consequence, a bill processing unit that can maintain stable genuine bill identification capability can be provided, preventing damage of the bill identification means by a mischievous act as much as possible.

Also in accordance with both of the first and second bill processing units, the bottom chute of the horizontal portion and the upstream bottom chute of the vertical portion are integratedly formed by the box, this box is removably attached to the main body, and the connector comprising a plug and receptacle is disposed on the side of this box and the side of the main body facing this side of the box. When the box is attached to the main body, the plug and receptacle can be plugged, which completes the electrical connection operation between the main body and the box. Therefore, unlike the conventional type where the main body and the box are connected by a connector disposed between the pair of cables, the maintenance and inspection operations for connection and disconnection can be easily carried out.

INDUSTRIAL APPLICABILITY

As described above, the present invention is suitable for a bill processing unit that prevents a drop of genuineness identification capability to an inserted bill as much as possible even if the bill slot is subject to a mischievous act.

What is claimed is:

1. A bill processing unit comprising:

a bill transporting route having a horizontal portion disposed substantially in a horizontal direction directly downstream of a bill slot and a vertical portion disposed rising up substantially in a vertical direction from a downstream end of the horizontal portion;

bill transporting means for transporting a bill inserted from the bill slot along the bill transporting route; and bill identification means disposed in the middle of the bill transporting route for identifying the genuineness of the bill being transported, the bill transporting route, the bill transporting means and the bill identification means being provided in a main body of the unit, wherein the bill identification means is disposed in the vertical portion of the bill transporting route; and the horizontal portion and the vertical portion of the bill transporting route are defined by respective top and bottom chutes disposed with a predetermined space therebetween, of which the bottom chute of the horizontal portion and an upstream portion of the bottom chute of the Vertical portion are integratedly formed by a box, and the box is removably attached to the main body of the unit.

2. The bill processing unit according to claim 1, characterized in that a connector comprising a plug and a receptacle, one of the plug and receptacle being disposed on a side of the box and another being disposed on a side of the main body of the unit facing to the side of the box so that when the box is attached to the main body of the unit, the plug is plugged into the receptacle and the main body of the unit, whereby the box are electrically connected to the main body of the unit.

3. A bill processing unit comprising:

a bill transporting route having a horizontal portion disposed substantially in a horizontal direction from a bill slot and a vertical portion disposed rising up substantially in a vertical direction from a downstream end of the horizontal portion;

bill transporting means for transporting a bill inserted from the bill slot along the bill transporting route;

bill identification means disposed in the middle of the bill transporting route for identifying the genuineness of the bill being transported; and shutter means disposed in the middle of the bill transporting route for opening or closing the bill transporting route at predetermined timing, the bill transporting route, the bill transporting means, the bill identification means and shutter means being provided in a main body of the unit, characterized in that the bill identification means is disposed in the vertical portion of the bill transporting route, and the shutter means is disposed in the vertical portion of the bill transporting route which is located upstream of the bill identification means, so that the shutter means normally closes the bill transporting route.

4. The bill processing unit according to claim 3, characterized in that the horizontal portion and the vertical portion of the bill transporting route are defined by respective top and bottom chutes disposed with a predetermined space therebetween, of which the bottom chute of the horizontal portion and an upstream portion of the bottom chute of the vertical portion are integratedly formed by a box, and the box is removably attached to the main body of the unit.

5. The bill processing unit according to claim 4, characterized in that a connector comprising a plug and a receptacle, one of the plug and receptacle being disposed on a side of the box and another being disposed on a side of the main body of the unit facing to the side of the box so that when the box is attached to the main body of the unit, the plug is plugged into the receptacle and the main body of the unit, whereby the box is electrically connected to the main body of the unit.

* * * * *